US005409185A

United States Patent [19]

Oldakowski

[11] Patent Number: 5,409,185

[45] Date of Patent: Apr. 25, 1995

[54] FIN CONTROL ACTUATOR HAVING A FIN SHAFT LOCK DEVICE

[75] Inventor: Stephen Z. Oldakowski, Bedford, Ohio

[73] Assignee: Lucas Aerospace Power Equipment Corporation, Aurora, Ohio

[21] Appl. No.: 90,801

[22] Filed: Jul. 12, 1993

[51] Int. Cl.[6] ..... B64C 13/24

[52] U.S. Cl. ..... 244/75 R; 244/3.24; 244/224

[58] Field of Search ..... 244/3.21, 3.24, 224, 244/75 R, 75 A

[56] References Cited

U.S. PATENT DOCUMENTS

| | | | |
|---|---|---|---|
| 2,294,906 | 9/1942 | Holloman | 244/224 |
| 2,584,038 | 1/1952 | Morrison | 244/224 |
| 2,869,386 | 1/1959 | Hoover | 244/75 R |
| 3,001,474 | 9/1961 | McLean | 244/3.21 |
| 3,154,015 | 10/1964 | Muller | 244/3.21 |
| 4,173,322 | 11/1979 | Macdonald | 244/224 |
| 4,603,594 | 8/1986 | Grimm | 244/75 R |

FOREIGN PATENT DOCUMENTS

| | | | |
|---|---|---|---|
| 69838 | 9/1949 | Denmark | 244/224 |

*Primary Examiner*—Galen L. Barefoot

*Attorney, Agent, or Firm*—Rankin, Hill, Lewis & Clark

[57] ABSTRACT

A fin control actuator for missiles carried on aircraft has a device which locks the fin shaft against aerodynamic loads and prevents the transmission of these loads through the drive train. The fin shaft lock includes a plunger which has a cam having a locking portion for engaging the output shaft and preventing the output shaft from rotating in one direction when the plunger is in the locking position. The cam also has a camming portion for engaging the output shaft and pushing the plunger to the retracted position when the output shaft rotates in the opposite direction. The plunger is urged into the locking position by a spring and is held in the retracted position by a permanent magnet. The fin lock device is reusable and does not consume any power after it is set.

14 Claims, 3 Drawing Sheets

FIN CONTROL ACTUATOR HAVING A FIN SHAFT LOCK DEVICE

BACKGROUND OF THE INVENTION

1. Field of the Invention

This invention relates to fin control actuators for missiles carried on aircraft, and more particularly to a system for locking the fin shaft against aerodynamic loads and preventing the transmission of these loads through the drive train.

2. Description of the Prior Art

Missiles carried on aircraft have various control devices to control the flight and operation of the missile after launch. In certain missiles, the control of the missile is accomplished through control and position of the fins on the missile. The fin shaft is connected to an output shaft that is rotated by connection to a control motor. The output shaft is connected to the control motor through a drive train.

During flight before launch, the fin shaft is subjected to high aerodynamics loading. This loading causes the fin shaft to tend to move in the direction of the load and causes the output shaft to tend to rotate. The motor which is connected to the output shaft is provided with a brake that stops rotation of the output shaft. The aerodynamic load applied to the fins is, however, still transmitted to the motor brake through the drive train that connects the motor to the output shaft, causing flutter and fatigue failures.

To prevent the transmission of this aerodynamic loading through the drive train, a "one shot" pyrotechnical device is sometimes provided to lock the fin shaft. However, this device cannot be re-used and is subject to possible failure. In addition, the use of pyrotechnics in the control system of weapons devices, such as missiles, is always subject certain inherent dangers and presents other disadvantages. While a mechanical locking device would be desirable, none are known.

SUMMARY OF THE INVENTION

The present invention overcomes the problems of the prior art and provides other advantages that have not be realized heretofore. In accordance with the present invention, a fin shaft locking device is provided which produces positive and secure locking of the fin shaft and the output shaft against aerodynamic loading applied to the fins during flight. The fin lock device of the present invention holds external loads to the output shaft and prevents the transmission of these loads through the drive train, and thus protects the drive train and the motor brake from flutter and fatigue failures.

Unlike pyrotechnic devices of the prior art, the fin lock device of the present invention is reusable. The fin lock device of this invention is completely mechanical and can be reused simply by resetting the lock after use. In one embodiment of the invention, the device may be provided with an automatic reset mechanism so that it may be reset remotely.

By providing a mechanical device that avoids the pyrotechnics of the prior art, the present invention affords safety and reliability not provided by prior devices. The invention utilizes a spring to set the lock and a permanent magnet to maintain the lock in an unlocked state, thus providing dependable and reliable operation entirely through the use of mechanical elements.

In accordance with the present invention, the fin lock device does not consume any power after it is set. This provides a highly advantageous fin locking device for use in aerospace applications where power resources are extremely limited and the consumption of power over a prolonged period should be avoided.

These and other advantages are provided by the present invention of a fin control actuator for airborne missiles which comprises an actuating motor having a brake, a rotating output shaft connected to a fin shaft, a drive train connecting the motor to the output shaft, and a fin lock device for holding the output shaft when the motor brake is on. The fin lock device includes a plunger capable of movement toward the output shaft into a locking position and away from the output shaft into a retracted position, spring means for urging the plunger into the locking position, magnet means for holding the plunger in the retracted position in opposition to the spring, and a cam attached to the plunger. The cam has a locking portion for engaging the output shaft and preventing the output shaft from rotating in one direction when the plunger is in the locking position. The cam also having a camming portion for engaging the output shaft and pushing the plunger to the retracted position.

DETAILED DESCRIPTION OF THE PREFERRED EMBODIMENT

Figure 1:
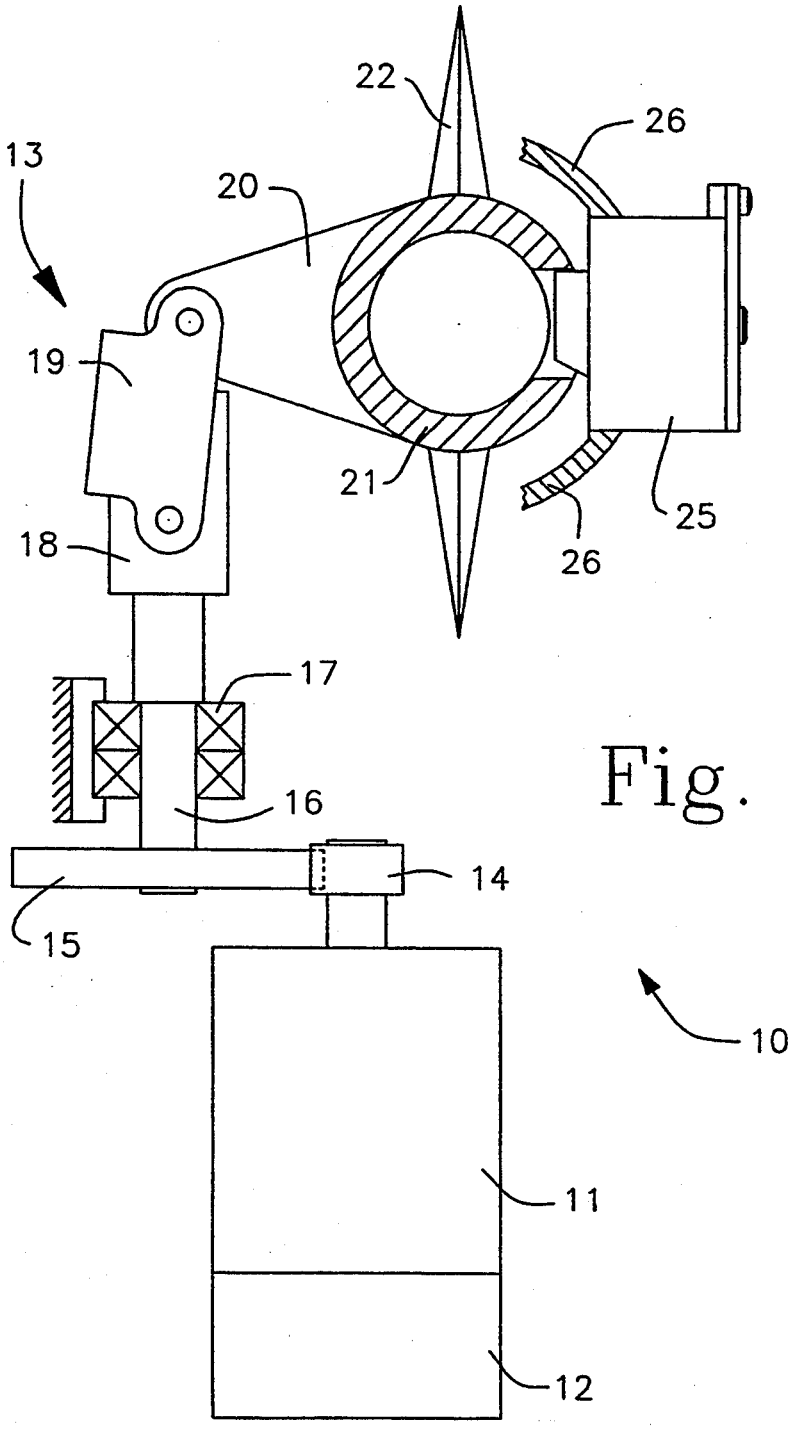
FIG. 1 is a schematic diagram of a fin control actuator incorporating the fin lock device of the present invention.

Referring more particularly to the drawings, and initially to FIG. 1, there is shown a fin control actuator 10 having the fin lock system of the present invention. The actuator 10 includes an actuating motor 11 having a brake 12. The output shaft of the motor 11 is connected to drive train 13 which includes a gear 14 mounted on the motor shaft which engages a larger speed-reducing gear 15 mounted on a drive shaft 16 which is journalled within bearings 17, a ballscrew 18 mounted on the drive shaft 16, a linkage member 19 connected to the ballscrew 18 which is connected to a flange 20 on an output shaft 21, so that actuation of the motor 11 causes the output shaft 21 to rotate a through limited angle in either direction. The fin shafts 22 are mounted on the output shaft. The motor brake 12 and the elements used in the drive train 13 are well known in design of prior art fin control actuators and need not be described here in further detail.

In accordance with the present invention, a fin lock device 25 or 125 is fixedly mounted on a shaft housing 26 that surrounds the output shaft 21 and is capable of engaging the output shaft to lock the shaft from rotation in one direction and thus lock movement of the fin shafts 22.

Figure 2:
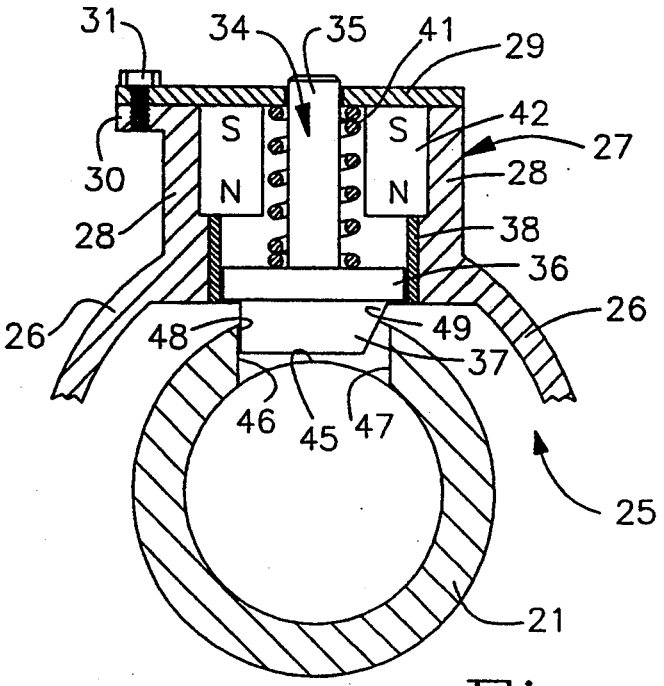
FIG. 2 is a cross sectional view of one embodiment of the fin lock device of the present invention shown in its locking position.
Figure 3:
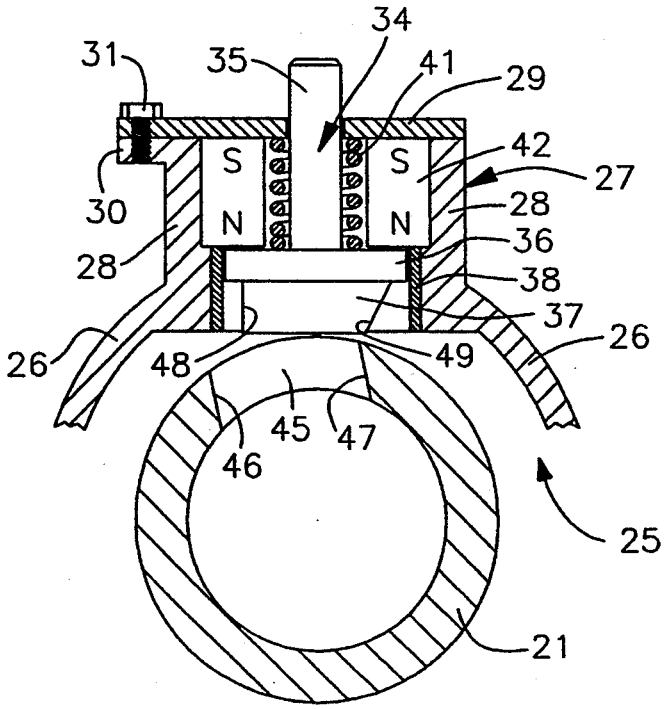
FIG. 3 is a cross sectional view similar to FIG. 2 of the fin lock device of FIG. 2 shown in its retracted and unlocked position.

One embodiment of the fin lock device of the present invention is shown in FIGS. 2 and 3. Referring to FIG. 2, the fin lock device 25 is contained within a housing 27 which comprises a cylindrical side wall 2S which is integral with the shaft housing 21 and extends axially outwardly from the shaft housing. A cylindrical chamber is created within the housing 27 by the side wall 28. The outer portion of the fin lock device housing 27 is formed by a circular cover 29 which is attached to a flange 30 extending from the side wall 28 by a bolt 31 or other fastener.

Inside the fin lock device housing 27 is a plunger 34 which is capable of moving axially toward and away from the output shaft 21. The plunger 34 includes a rod portion 35, a disk portion 36 and a cam 37. The rod portion 35 extends through a corresponding opening in the cover 29 and is held in position within this opening. The disk portion 36 fits within the cylindrical side wall 2S of the housing 27. A bushing 38 is provided around the disk portion 36 within the inside surface of the side wall 28 to facilitate axial movement of the plunger 34 toward and away from the output shaft 21. At least the disk portion 36 of the plunger 34 is made from a ferrous material or other magnetically attractive material.

The plunger 34 is urged to an extended position or locking position toward the output shaft 21 by a compression spring 41 which is mounted around the rod portion 35 of the plunger between the cover 29 and the disk portion 36 and which urges the disk portion of the plunger away from the cover. The plunger 34 is also capable of being maintained in a retracted position away from the output shaft 21 by attraction to a permanent magnet 42. The permanent magnet 42 is toroidal in shape and fits within the fin lock device housing 27 formed within the cylindrical side wall 28 and is positioned adjacent to the cover 29. Within the central opening of the toroidal permanent magnet 42 are the plunger rod portion 35 and the spring 41.

As shown in FIG. 2, the output shaft 21 is hollow and is provided with a slot 45 which is capable of being engaged by the cam 37 on the outer end of the plunger 34. The slot 45 has two generally parallel sides 46 and 47. When the output shaft 21 is positioned in its locking position adjacent to the fin lock device 25, as shown in FIG. 2, the planes of the sides 46 and 47 of the slot 45 are generally parallel to the plane containing the axis of the output shaft 21 and containing the axis of movement of the plunger 34 of the fin lock device 25. The cam 37 extends toward to output shaft 21 from the outer surface the disk portion 36 of the plunger 34. The plane of the outer surface of the disk portion 36 is parallel to a plane which is tangential to the outer surface of the output shaft 21. The cam 37 has a locking surface 48 on one side which extends generally perpendicular to the outer surface of the disk portion. The cam 37 also has a camming surface 49 on the other side which extends at an angle with respect to the outer surface of the disk portion 36 and which extends toward the axis of movement of the plunger.

As can be seen in FIG. 2, when the output shaft 21 is positioned in its locking position adjacent to the fin lock device 25, the locking surface 48 of the plunger cam 37 extends in generally the same plane as the side 46 of the slot 45 in the output shaft, so that when the cam 37 extends into the output shaft and the locking surface 48 engages the side 46 of the slot, the output shaft is locked from further rotation in that direction. In other words, the locking surface 48 engages the side 46 to prevent further rotation of the output shaft in the clockwise direction as shown in FIG. 2.

With further reference to FIG. 2, it can be seen that, when the output shaft 21 is positioned in its locking position adjacent to the fin lock device 25, the camming surface 49 of the plunger cam 37 extends away from the other side 47 of the slot 45, so that when the cam 37 extends into the output shaft and the camming surface 49 engages the side 47 of the slot, rotation of the output shaft in the opposite direction causes the side of the slot to engage the camming surface 49 and urge the cam 37 out of the slot. In other words, when the cam 37 is in the slot 45 and the output shaft 21 rotates in the counterclockwise direction as shown in FIG. 2, the engagement of the camming surface 49 with the side 47 of the slot 45 pushes the plunger 34 away from the output shaft. The plane of the camming surface 49 should be such that it is capable of pushing the plunger 34 away from the output shaft 21 during a maximum aerodynamic load on the fin shaft. This angle will depend upon the loading to which the fins are subjected and the force of the spring 41.

The fin lock device 25 operates to lock the output shaft 21 against rotation in one direction without the necessity of external power. As shown in FIG. 2, the fin lock device 25 is set in its locking position in engagement with the output shaft 21. With the slot 45 is positioned opposite the fin lock device 25, the spring 41 urges the plunger 34 to its extended position toward the output shaft and the cam 37 engages the slot 45. The output shaft 21 is then locked and further rotation is prevented in one direction, i.e., the clockwise direction as shown in FIG. 3. The motor 11 is then commanded to rotate the output shaft 21 in the locking position (in the clockwise direction as shown in FIG. 2) to hold the output shaft in locking engagement with the cam 37 and to remove all backlash and wind-ups in the drive train 13. With the output shaft 21 and the drive train 13 fully pushed to the locking position, the motor brake 12 is set to lock the drive train into this wound condition. The brake torque is designed to retain the brake output locked against maximum aerodynamic loads during flight.

To unlock the output shaft 21 the motor brake 12 is released by electrically energizing its coil, and the motor 11 is operated to rotate the output shaft in the direction opposite the direction in which it is locked, i.e., it is rotated in the counterclockwise direction as shown in FIG. 2. Rotation of the output shaft 21 in this direction causes the camming surface 49 to engage the side 47 of the slot 45 and urge the plunger 34 away from the output shaft 21 in opposition to the spring 41. When the plunger 34 has been pushed fully inwardly, the disk portion 36 of the plunger engages the permanent magnet 42, and the magnetic attraction of the disk portion to the magnet causes the plunger to be held in its retracted position as shown in FIG. 3. The output shaft 21 is then free to rotate in either direction.

It can be seen that the fin lock device 25 of FIGS. 2 and 3 is essentially a "one shot" device, that is, it a capable of a single locking operation. After the plunger has been pushed back against the magnet, the device 25 will not re-lock the shaft until the device is reset. The device 25 can be reset manually by engaging the outer end of the rod portion 35 of the plunger that extends through the cover 29 to push the plunger away from the magnet so that the force of the spring 41 again overcomes the magnetic attraction of the plunger disk portion to the magnet 42 and the cam 37 again engages the slot 45 on the output shaft 21

Figure 4:
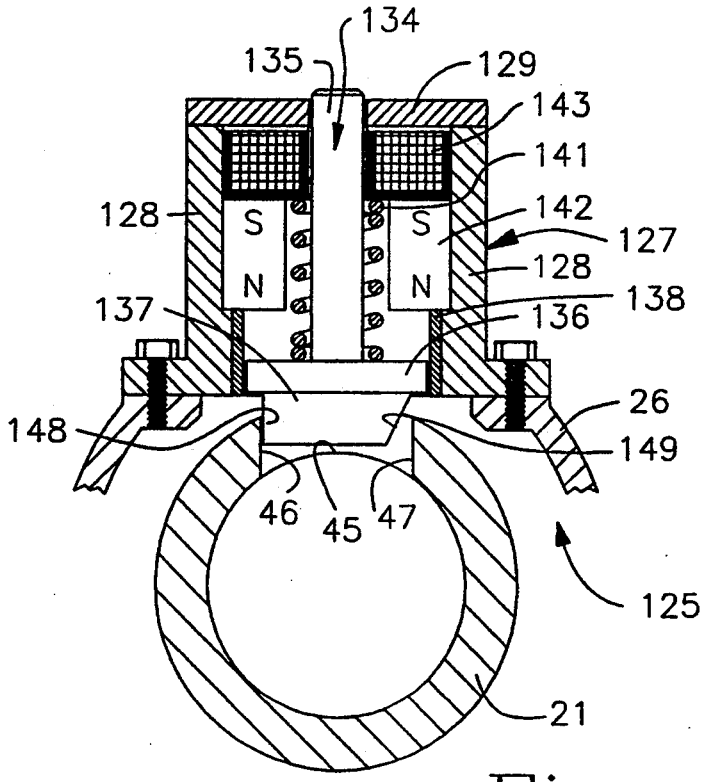
FIG. 4 is a cross sectional view similar to FIG. 2 and 3 of another embodiment of the fin lock device of the present invention shown in its locking position.
Figure 5:
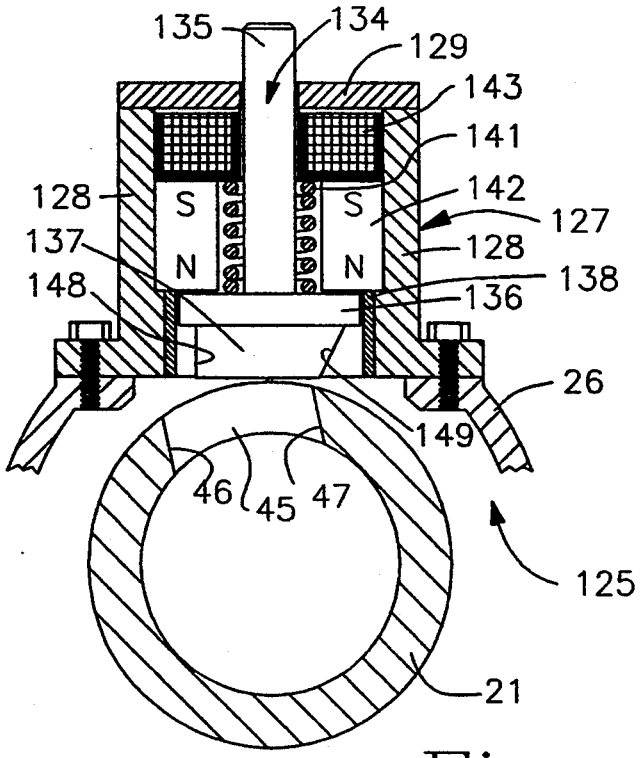
FIG. 5 is a cross sectional view similar to FIGS. 2–4 of the fin lock device of FIG. 4 shown in its retraced and unlocked position.

FIGS. 4 and 5 show an alternative embodiment of the present invention that provides a fin lock device 125 with an automatic reset. Referring to FIG. 4, the fin lock device 125 is contained in a housing 127 which comprises a cylindrical magnetic core 128 which is mounted on the shaft housing 26. The housing 127 is enclosed by a cover 129 which is attached to the outer portion of the magnetic core. Mounted within the fin lock device housing 127 is a plunger 134 which is generally similar to the plunger 34 with a slightly longer rod portion 135 along with a similar disk portion 136 and cam 137. The plunger 134 moves axially within the housing 127 toward and away from the output shaft 21 with the rod portion 135 of the plunger 134 riding within an opening in the cover 129 and the disk portion 131 of the plunger riding within a bushing 138 provided within the side walls of the housing 127. The plunger 134 is urged toward its extended position or locking position by a compression spring 141. A toroidal-shaped permanent magnet 142 is provided within the fin lock device housing 127 around the rod portion 135 of the plunger 34 and around the spring 141.

A solenoid 143 is also provided within the housing next to the permanent magnet 142. The solenoid 143 also has a central opening through which extends the rod portion 135 of the plunger 134. The spring 141 is positioned around the rod portion 135 between the solenoid 143 and the disk portion 136.

The cam 137 engages the slot 45 in the output shaft 21 in the same manner as the cam 37, locking the output shaft from movement in one direction (the clockwise direction in FIG. 4) and causing the plunger 134 to be pushed away from the output shaft 21 when the output shaft rotates in the other direction (the counterclockwise direction in FIG. 4). The cam 137 has a locking surface 148 that engages one side 46 of the slot 45 and has a camming surface 149 that engages the other side 47 of the slot. The surfaces 148 and 149 are configured similar to the surfaces 48 and 49.

The operation of the fin lock device 125 is generally similar to that of the fin lock device 25 except for its ability to be automatically reset. With the slot 45 positioned adjacent to the cam 137, the cam moves into the slot by the action of the spring 141 pushing the plunger 134 into its extended position or locking position. The output shaft 21 is then locked against movement in one direction (the clockwise direction as shown in FIG. 4) by the engagement of the locking surface 148 of the cam against the side 46 of the slot. The motor 11 is operated to drive the output shaft 21 in the locking position and to wind the drive train 13 to remove all slack and backlash. The motor brake 12 is then set to hold the drive train 13 in this wound condition. The motor brake 12 holds the fin shafts against maximum aerodynamic loads.

To unlock the system, the motor brake 12 is released, and the motor 11 is actuated to drive the output shaft 21 in the other direction (the counterclockwise direction as shown in FIG. 4). The other side 47 of the slot 45 engages the camming surface 149 of the cam to push the plunger 134 toward its retracted position into the housing 127. The plunger 134 is urged away from the output shaft 21 until the disk portion 136 of the plunger engages the permanent magnet 142. The magnetic attraction between the disk portion 136 of the plunger and the permanent magnet 142 holds the plunger in its retracted position, and the output shaft 21 is then free to rotate in either direction.

The fin lock device 125 is returned to its locking position at any time by momentarily energizing the solenoid 143 when the slot 45 in the output shaft 21 is in position opposite the cam 37. The momentary energizing of the solenoid 143 creates a magnetic flux through the magnetic core 128 with a polarity opposite that permanent magnet 142 and allows the spring 141 to overcome the magnetic attraction of the disk portion 136 to the permanent magnetic 142, allowing the plunger 134 to move toward the output shaft 21 so that the cam 37 enters the slot 45 to lock the output shaft in place.

While both the fin lock device 25 of FIGS. 2 and 3 and the fin lock device 125 of FIGS. 4 and 5 are capable of being reset, the fin lock device 125 provides the capability of being reset from a remote location by momentary energizing of the solenoid 143 while the fin lock device 25 must be reset manually by manual actuation of the plunger rod portion 35 that extends through the cover 29. Thus, the fin lock device 125 is advantageous in applications in which in may be necessary to reset the device for locking more than once during the operation of the missile.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described nor in any other way this is inconsistent with the extent to which the progress in the art has been advanced by the invention.

What is claimed is:

1. A fin control actuator for airborne missiles, which comprises:

an actuating motor having a brake;

a output shaft connected to a fin shaft and capable of rotating in a first direction and a second direction;

a drive train connecting the motor to the output shaft; and a fin lock device for holding the output shaft when the motor brake is on, the fin lock device including a plunger capable of movement toward the output shaft into a locking position and away from the output shaft into a retracted position, spring means for urging the plunger into the locking position, permanent magnet means for holding the plunger in the retracted position in opposition to the spring means, and a cam attached to the plunger, the cam having a locking portion for engaging the output shaft and preventing the output shaft from rotating in the first direction when the plunger is in the locking position, the cam also having a camming portion for engaging the output shaft and pushing the plunger to the retracted position.

2. A fin control actuator as defined in claim 1, wherein the camming portion of the cam engages the output shaft and pushes the plunger to the retracted position when the output shaft rotates in the second direction.

3. A fin control actuator as defined in claim 1, wherein the output shaft has a slot, the locking portion of the cam including a locking surface for engaging one side of the slot to prevent the output shaft from rotating in one direction, the camming portion of the cam including a camming surface for engaging another side of the slot to push the plunger to the retracted position.

4. A fin control actuator as defined in claim 1, comprising in addition, solenoid means for remotely releasing the plunger from the retracted position.

5. A fin control actuator as defined in claim 1, wherein the drive train has backlash, and the motor is driven to rotate the shaft in said one direction before moving the cam into engagement with the output shaft and before setting the brake and to wind-up the drive train and hold the output shaft in a locked condition.

6. A shaft locking device for locking a shaft for rotation in one direction, comprising:

a plunger capable of movement toward the shaft into a locking position and away from the shaft into a retracted position;

spring means for urging the plunger into the locking position;

permanent magnet means for holding the plunger in the retracted position in opposition to the spring means; and a cam attached to the plunger, the cam having a locking surface for engaging the shaft and prevent the shaft from rotating in said one direction, the cam also having a camming surface for engaging the shaft and pushing the plunger to the retracted position when the shaft rotates in a direction opposite of said one direction.

7. A shaft locking device as defined in claim 6, comprising in addition, solenoid means for remotely releasing the plunger from the retracted position.

8. A shaft locking device as defined in claim 7, wherein the solenoid means produces magnetic flux in opposition to the permanent magnet means to overcome magnetic attraction between the plunger and the permanent magnet means.

9. A shaft locking device as defined in claim 6, wherein the permanent magnet means is a toroidally shaped permanent magnet having a hollow core and wherein a portion of the plunger extends within the core of the magnet.

10. A shaft locking device as defined in claim 9, wherein the spring means is located within the core of the permanent magnet.

11. A shaft locking device as defined in claim 6, wherein the plunger is located within a housing and wherein the plunger includes a rod portion which extends through a opening in the housing, the rod portion capable of manual engagement to move the plunger from the retracted position to the locking position.

12. A shaft locking device for locking a shaft for rotation in one direction, comprising:

a shaft having a slot therein, the shaft capable of rotating in opposite first and second directions;

a plunger capable of movement between a locking position toward the shaft and a retracted position away from the shaft;

spring means for urging the plunger into the locking position;

permanent magnet means for holding the plunger in the retracted position in opposition to the spring means;

a cam attached to the plunger and moving into the slot when the plunger is in the locking position, the cam having a locking surface for engaging one side of the slot to prevent the shaft from rotating in the first direction, the cam also having a camming surface for engaging another side of the slot to push the plunger to the retracted position when the shaft rotates in the second direction.

13. A shaft locking device as defined in claim 12, comprising in addition, solenoid means for remotely releasing the plunger from the retracted position.

14. A shaft locking device as defined in claim 13, wherein the solenoid means produces magnetic flux in opposite to the permanent magnet to overcome magnetic attraction between the plunger and the permanent magnet means.

* * * * *

UNITED STATES PATENT AND TRADEMARK OFFICE

CERTIFICATE OF CORRECTION

PATENT NO. : 5,409,185

DATED : April 25, 1995

INVENTOR(S) : Stephen Z. Oldakowski

It is certified that error appears in the above—identified patent and that said Letters Patent is hereby corrected as shown below:

Col. 3, line 4 "2S" should be --28--
Col. 3, line 5 "21" should be --26--
Col. 3, line 19 "2S" should be --28--
Col. 5, line 2 after "21" should be --.--
Col. 5, line 18 "131" should be --136--
Col. 5, line 25 after "housing" should be --127--
Col. 8, line 40 "opposite" should be --opposition--

Signed and Sealed this

Twenty-fifth Day of July, 1995

Bruce Lehman

*Attest:*

BRUCE LEHMAN

*Attesting Officer*

*Commissioner of Patents and Trademarks*